US008065814B2

(12) United States Patent
Olvera

(10) Patent No.: US 8,065,814 B2
(45) Date of Patent: Nov. 29, 2011

(54) FOOT DRYING DEVICE

(76) Inventor: Guadalupe Olvera, Richland, WA (US)

( * ) Notice: Subject to any disclaimer, the term of this patent is extended or adjusted under 35 U.S.C. 154(b) by 0 days.

(21) Appl. No.: 12/484,593

(22) Filed: Jun. 15, 2009

(65) Prior Publication Data

US 2010/0313438 A1 Dec. 16, 2010

(51) Int. Cl.
*F26B 19/00* (2006.01)
*F26B 25/06* (2006.01)

(52) U.S. Cl. ..... 34/218; 34/232; 34/233; 34/90

(58) Field of Classification Search ..... 34/218, 34/202, 524, 237, 233, 343, 427, 90, 91, 34/232, 231, 235, 234, 104; 601/16, 104
See application file for complete search history.

(56) References Cited

U.S. PATENT DOCUMENTS

| | | | | |
|---|---|---|---|---|
| 1,658,489 | A | 12/1925 | Lindstrom | |
| 3,089,942 | A | 5/1963 | Wrigglesworth et al. | |
| 3,378,009 | A | 4/1968 | Peplin | |
| 3,683,896 | A | 8/1972 | Peplin | |
| 3,939,825 | A * | 2/1976 | Krummenacher | 601/104 |
| 4,492,221 | A | 1/1985 | Kerley | |
| 4,782,601 | A | 11/1988 | Gonzalez | |
| 5,157,850 | A | 10/1992 | Terng-Shuh | |
| 5,438,764 | A | 8/1995 | Reppas et al. | |
| 5,454,060 | A | 9/1995 | McDermott | |
| 5,475,933 | A | 12/1995 | Ueda | |
| 5,491,908 | A | 2/1996 | Ruiz et al. | |
| 5,497,908 | A | 3/1996 | Cheek, III et al. | |
| 5,613,304 | A | 3/1997 | Lin | |
| 5,675,907 | A | 10/1997 | Reppas et al. | |
| 5,819,431 | A | 10/1998 | Lancer | |
| 5,826,347 | A | 10/1998 | Livares-Gonzales de Serrano et al. | |
| 6,105,023 | A | 8/2000 | Callan | |
| 6,393,717 | B1 | 5/2002 | Santos et al. | |
| 6,698,038 | B2 * | 3/2004 | Bastia et al. | 4/622 |
| 6,705,023 | B1 | 3/2004 | Hoover | |
| 7,278,225 | B1 | 10/2007 | Espinosa | |
| 2002/0189125 | A1 | 12/2002 | Lancer | |
| 2002/0194746 | A1 | 12/2002 | Lancer | |
| 2007/0078361 | A1 * | 4/2007 | Wong et al. | 601/29 |
| 2008/0010851 | A1 * | 1/2008 | Avanzini | 34/90 |

* cited by examiner

*Primary Examiner* — Kenneth Rinehart
*Assistant Examiner* — Corey J Hall
(74) *Attorney, Agent, or Firm* — Robert L. Shaver

(57) ABSTRACT

A foot dryer designed to provide air flow between a patient's toes for drying the bottoms of a patient's feet and especially between their toes. Toe separators are provided on a pair of replaceable gel foot beds for improved sanitation and comfort for the patient. The footpads are replaceable in order to decrease cross contamination from one user to another. Air vents are provided to direct air flow to hard to dry areas such as between a user's toes.

1 Claim, 4 Drawing Sheets

FOOT DRYING DEVICE

FIELD OF THE INVENTION

The invention generally relates to an improved drying device for human feet, and more particularly to a drying device for directing air flow between the toes and to the bottom of a patient's feet.

BACKGROUND OF THE INVENTION

There are many situations in which a patient's feet may become wet, such as during bathing. It is important that a patient's feet be dried after being wet to prevent the growth of bacteria, yeast, and fungus. It is also critical that these microbes are not spread from one patient's feet to other patients.

It is important for a person's feet to be dry, to prevent growth of microbes such as yeast, bacteria, and fungus. Certain patient's have great difficulty in drying every part of their feet, particularly between the toes. This can happen when a person has reduced feeling in their feet, when touching their feet is painful, if they cannot reach their feet, or if touching the feet may tear the skin. In each of these situations, it would be beneficial to have a foot dryer which would assist the patient in drying their feet, and which would assure that areas between the patient's toes are also dried. It would also be beneficial to have a foot drying device that prevented cross contamination of microbes from one person's feet to another person's feet.

SUMMARY OF THE INVENTION

These and other objects are accomplished by the foot drying device of the present invention. The foot drying device includes a device body in which the other components of the device are contained. The device body has a top surface which may be flat or sloping. It also has four sides and a bottom surface. The top surface includes a pair of foot wells which may be recessed into the surface of the device body or defined by walls raised above the surface, and these serve as positions for mounting removable right and left foot pads.

The device body houses an air dispersion system which delivers air from an air flow generator to the base of the foot wells, and through the right and left foot pads to the surface of the foot pads for contact with a patient's feet.

The air flow generator may be a motor and fan, and the device body includes a switch for activating the air flow generator.

The right and left foot pads are preferably of a gel or soft material and have a top surface and a bottom surface. The top surface includes a number of protruding toe separators with space between the toe separators for patient's toes. The foot pads also include a number of air vents which penetrate from the top surface to the bottom surface of the foot pads. Air from the air dispersion system passes through the right and left foot pads and flows from the top surface of the foot pads into contact with the patient's feet and toes. The foot pads can be sized for different sizes of feet, with the outer dimension of all foot pads being the same, but with the toe separators and air vents configured for different sizes of feet.

The air vents in the foot pads are positioned so that an air vent is present at the part of the toe separator which will be adjacent to the point where a patient's toes are joined. In this way, a hard to reach area in the toes is guaranteed to have a flow of air and to be adequately dried.

An air dispersion system in the device body is provided to direct air which eventually goes into the air vents of the foot pads. One version of the air dispersion system is made up of an upper and lower plenum into which air from the air flow generator flows. From these plenums air may flow into the air vents of the foot pads.

The device can include a water removal opening, so that any water which may accumulate in the device may be drained out.

The purpose of the foregoing Abstract is to enable the public, and especially the scientists, engineers, and practitioners in the art who are not familiar with patent or legal terms or phraseology, to determine quickly from a cursory inspection, the nature and essence of the technical disclosure of the application. The Abstract is neither intended to define the invention of the application, which is measured by the claims, nor is it intended to be limiting as to the scope of the invention in any way.

Still other features and advantages of the present invention will become readily apparent to those skilled in this art from the following detailed description describing preferred embodiments of the invention, simply by way of illustration of the best mode contemplated by carrying out my invention. As will be realized, the invention is capable of modification in various obvious respects all without departing from the invention. Accordingly, the drawings and description of the preferred embodiments are to be regarded as illustrative in nature, and not as restrictive in nature.

DESCRIPTION OF THE PREFERRED EMBODIMENTS

Figure 1:
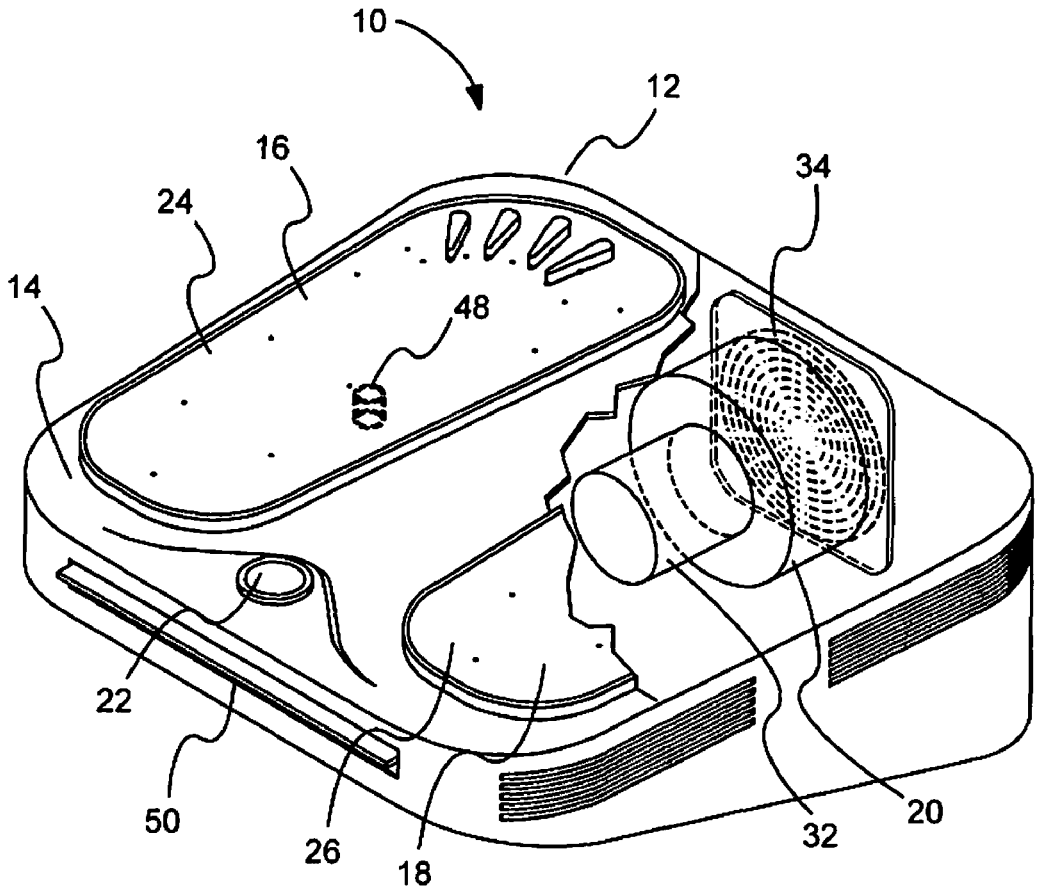
FIG. 1 is a perspective view of the foot dryer of the invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

A preferred embodiment of the invention is shown in FIGS. 1-5. FIG. 1 shows a perspective view of the foot drying device 10 with a device body 12, a top surface 14, a left foot well 16, and a right foot well 18. The left and right foot wells 16 and 18 are covered by a left and right foot pad 24 and 26 shown in a cutaway portion of the device 10 is a motor 32 with a fan 34. A switch 22 is also provided.

The device is preferably made of plastic, with the left and right foot pads 24 and 26 being removable from the left and right foot well 16 and 18. The left and right foot pads 24 and 26 are preferably made of a soft gel, and are perforated with a number of holes which correspond to the general configuration of a human foot. A drain opening 50 is shown in FIG. 1, through which water which may accumulate in the device may be drained.

Figure 2:
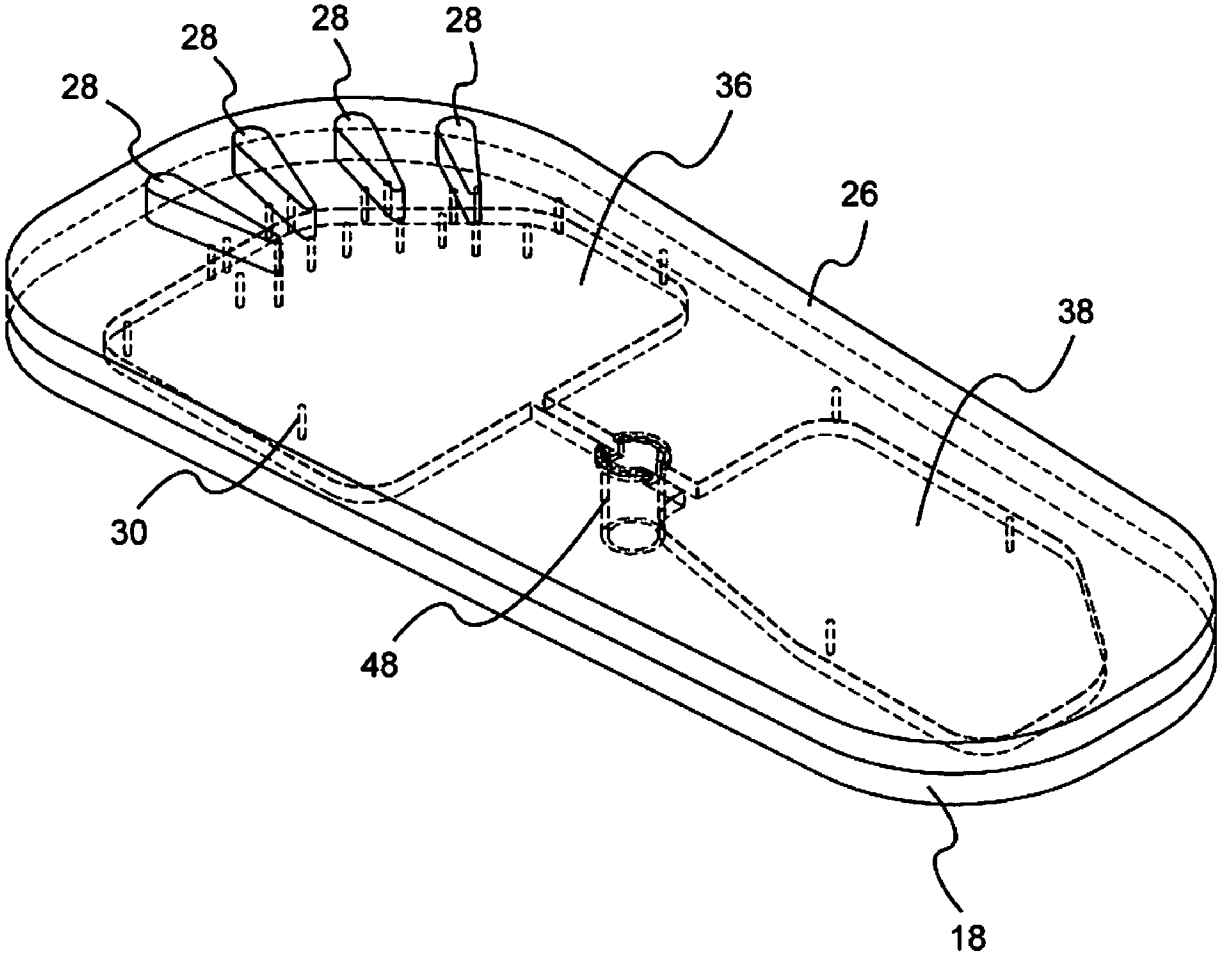
FIG. 2 is a perspective view of a foot well and foot pad of the invention.

FIG. 2 shows closer detail of the right foot well 18 and the right foot pad 26. In this embodiment the foot pad 26 is inserted into the recessed foot well 18, and partially extends above the top surface 14 of the device. Other embodiments can have the foot pad flush with the top surface 14, or have the foot well 16 and 18 including a raised wall that surrounds the edge of the foot pads 24 and 26. The foot pad defines a number of air vents 30, which are holes which pass through the foot pad 26. The foot pad 26 includes a number of toe separators 28. In the vicinity of the toe separators 28, and particularly at the apex of each toe separator 28, are located a number of the air vents 30. The air vents 30 in the region of the toes 46 and where the toes join the foot are provided for drying of moisture from a patient's feet 44, between their toes 46 and on the underside of the foot 44.

Shown in FIG. 2 are an upper plenum 36 and a lower plenum 38. Air from an air dispersion system 20, which is shown in FIG. 1, passes through an air delivery tube 48 and into the upper plenum 36 and the lower plenum 38. From the upper and lower plenum, air is forced into the air vents 30, and passes through the foot pads 24 and 26 and into the region of the patient's toes and feet.

Figure 3:
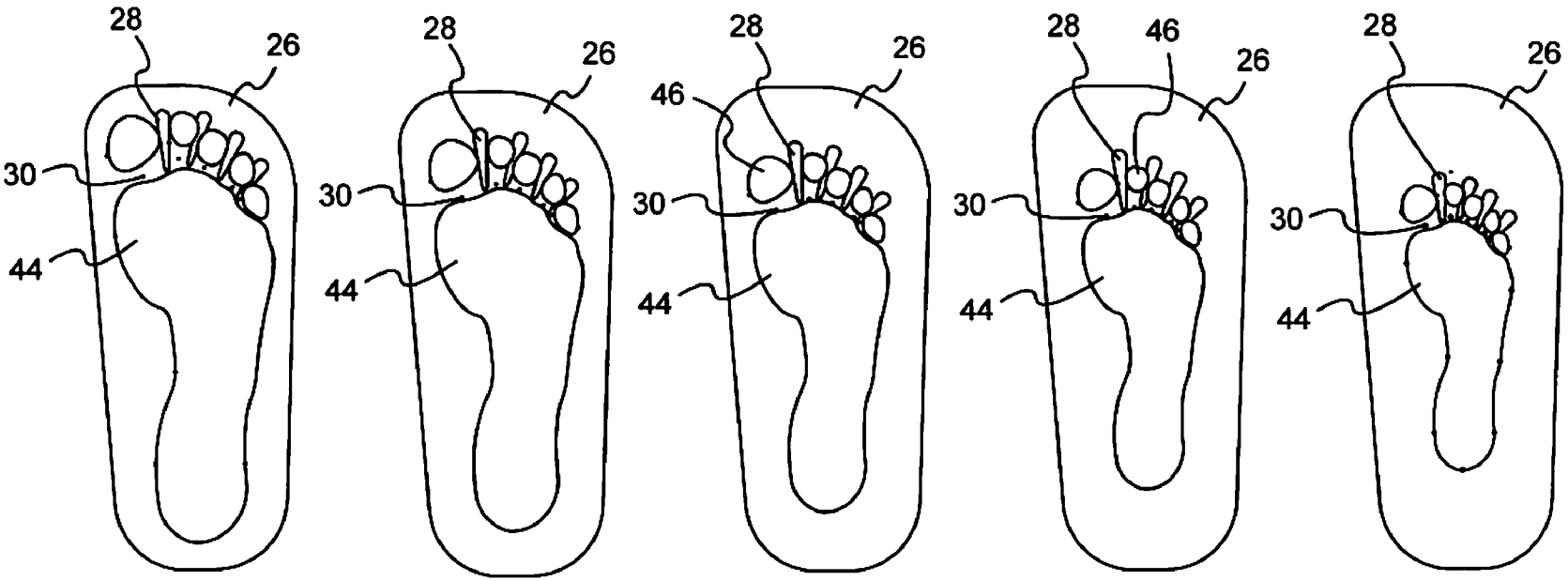
FIG. 3 shows foot pads from size large to size small, and the relation of the patient's foot with the toe separators.

FIG. 3 shows how the foot pads 24 and 26 may be configured to accommodate a wide range of patient foot sizes. The depiction of the foot pad on the left of the figure is for a large foot, and the depiction on the right side of the figure is for a small foot. For different sizes of feet, the configuration and size of the toe separators 28 would be changed, with the air vents 30 also changing position with the change in the size of the foot pad 26. The foot drying device 10 of the invention would be built to accommodate a variety of sizes of foot pads such as these, which would be interchangeable and which would allow the device to be utilized by patients with different sized feet. Changing the pads will ensure that no cross contamination of microbes occurs.

Figure 4:
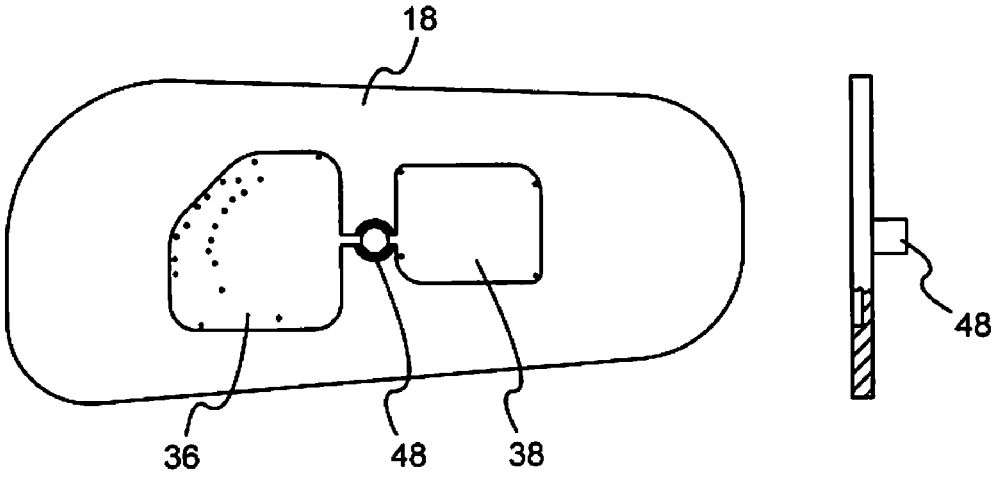
FIG. 4 shows a small size air plenum for use with a small size foot pad.
Figure 5:
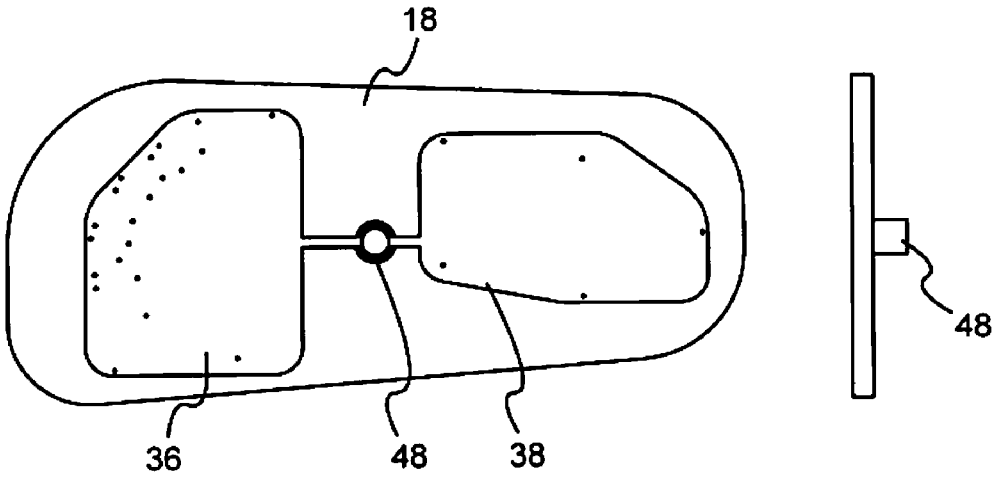
FIG. 5 is a top view of a large size foot pad.

FIG. 5 shows another replaceable and interchangeable unit of the invention and that is the upper plenum 36 and the lower plenum 38. In the version shown in FIGS. 4 and 5, FIG. 4 shows a plenum sized for a small foot, and FIG. 5 shows a pair of plenums sized for a large foot. These plenums would be defined in an insert which is placed in the footwell, and which would interact with the air delivery tube 48 to route air from the air dispersion system 20 into each of the plenums. From the plenums, air would be available to pass into the air vents 30 of the left and right foot pads.

The left and right foot pads of the invention provide a convenient sizing tool for the device and also allow the changing of the foot pads to maintain the sanitation of the foot drying device, and to prevent cross contamination. Thus, the foot drying device of the invention would be particularly useful in a hospital or a clinic setting in which a number of patients were going to use the foot drying device. This would also be advantageous for a patient using the foot drying device at home, because the patient could insert the proper size of foot pad and plenum insert and have a device which closely matched the contours of his own foot. If two people were sharing the use of the device at home, simply changing out these interchangeable parts would allow the machine to be tailored to fit the two patients in a home setting.

While there is shown and described to be the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

What is claimed is:

1. A foot drying device comprising:

a device body for housing device components, said device body comprising a sloping and generally flat top surface with a pair of raised walls on said top surface, with said raised walls approximately equal in height to a pair of foot pads, said raised walls defining a pair of foot wells with a base of said foot wells coplanar with said top surface, with each foot well defining a recessed upper plenum in ball of foot region, and a lower plenum in a heel of foot region, with an air dispersion system in a base surface of said foot wells, with said air dispersion system comprising a left and a right air conducting tubes for admitting air into a channel between said upper and lower plenem, for directing flow of air from an airflow generator to said upper and lower plenums in said foot well, with said foot wells and plenums covered by a right and left removable foot pads, with said foot pads defining a plurality of air vents positioned around a foot shaped periphery, with said foot pads configured for air passage through said air vents from said upper and lower air plenums, for delivery of air to a top surface of said foot pads;

a motor and fan airflow generator for pushing air into said device body and from said device body into said left and right air conducting tubes and said plenums defined in said foot wells and capped by said foot pads;

a switch for activating said air flow generator;

a water drain opening in said device body for removal of water from a user's feet which collects inside said device body;

with each foot pad further comprising a plurality of protruding toe separators with space for a patients' toes between said toe separators, with said foot pads further comprising a plurality of air vents defined in said foot pads with a concentration of said air vents adjacent to said toe separators, for directing air between a patient's toes, and around a periphery of a foot shape with said air vents functionally connected to said air dispersion system via said left and right air conducting tubes and said upper plenums in a toe area, and said lower plenums in said heel areas, for allowing air to pass through said left and right foot pads;

wherein said air flow generator provides air movement through said air vents in said right and left foot pads, so that moisture on a patient's feet and toes are dried in airflow from said air vents, and said removable right and left foot pads may be periodically replaced for purposes of sanitation.

* * * * *